US011359331B2

(12) United States Patent
Bottini

(10) Patent No.: US 11,359,331 B2
(45) Date of Patent: Jun. 14, 2022

(54) METHOD AND DEVICE FOR REVERSING A TUBULAR KNITTED ARTICLE IN A CIRCULAR KNITTING MACHINE

(71) Applicant: STÄUBLI ITALIA S.P.A., Carate Brianza (IT)

(72) Inventor: Fulvio Bottini, Robecchetto Con Induno (IT)

(73) Assignee: STÄUBLI ITALIA S.P.A., Carate Brianza (IT)

( * ) Notice: Subject to any disclaimer, the term of this patent is extended or adjusted under 35 U.S.C. 154(b) by 117 days.

(21) Appl. No.: 16/825,688

(22) Filed: Mar. 20, 2020

(65) Prior Publication Data

US 2020/0308759 A1 Oct. 1, 2020

(30) Foreign Application Priority Data

Mar. 26, 2019 (EP) ..... 19165317

(51) Int. Cl.
*D06G 3/02* (2006.01)
*D06C 5/00* (2006.01)

(52) U.S. Cl.
CPC ..... *D06G 3/02* (2013.01); *D06C 5/005* (2013.01)

(58) Field of Classification Search
CPC ... D06G 3/00; D06G 3/02; D06G 3/04; D05B 23/009
USPC ..... 223/39–42
See application file for complete search history.

(56) References Cited

U.S. PATENT DOCUMENTS 5,127,558 A * 7/1992 Paolo ..... D06G 3/04 223/42
5,392,970 A * 2/1995 Orosei ..... D06G 3/02 223/42
2010/0313607 A1* 12/2010 Lonati ..... D04B 9/40 66/148
2010/0313608 A1* 12/2010 Lonati ..... D04B 15/92 223/43
2018/0327944 A1* 11/2018 Lon ..... D04B 9/40

* cited by examiner

*Primary Examiner* — Nathan E Durham
(74) *Attorney, Agent, or Firm* — McGlew and Tuttle, P.C.

(57) ABSTRACT

A method for reversing a tubular knitted article (S) is disclosed. According to the method, the tubular knitted article (S), engaged at a first end thereof by a pick-up device (5) and hanging with a second end thereof from the pick-up device, is introduced in a reversing tube (15). The reversing tube (15) is moved through the pick-up device (5) so as to project with the upper end (15B) thereof above the pick-up device; and the reversing tube (15) is moved reciprocatingly up and down between an upper position and a lower position, while co-acting with a top clamping device (31) and a bottom clamping device (35) until the tubular knitted article (S) is entirely everted on the outer surface of the reversing tube (15).

16 Claims, 15 Drawing Sheets

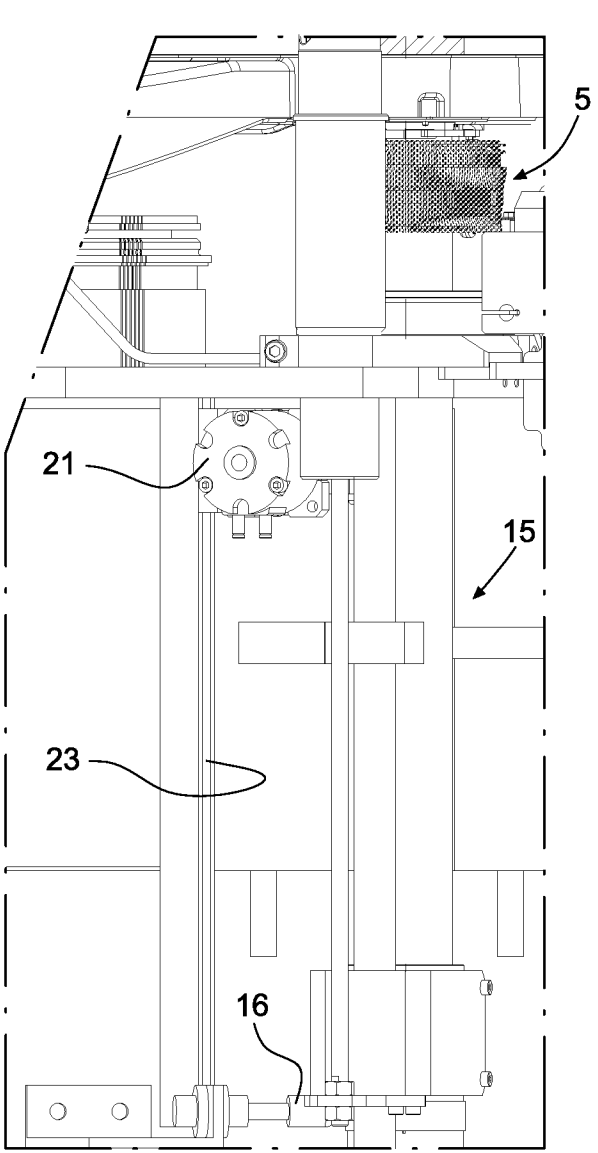
(B)
Fig.7
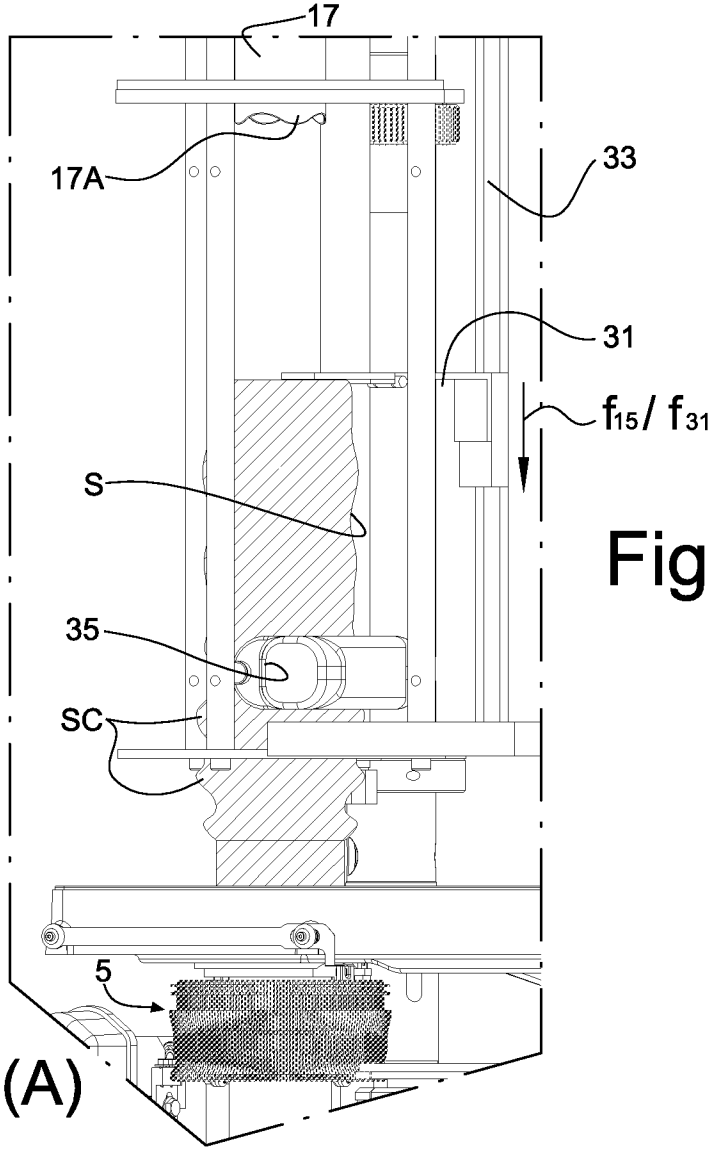
(A)

METHOD AND DEVICE FOR REVERSING A TUBULAR KNITTED ARTICLE IN A CIRCULAR KNITTING MACHINE

TECHNICAL FIELD

The invention concerns improvements to knitting machines and devices. More specifically, the invention concerns a device for reversing a tubular knitted article, such as a sock or a stocking, produced by a cylinder of needles, in order to close the toe end of the tubular knitted article. As commonly understood in the art, "reversing a tubular knitted article" means that the tubular article is turned inside-out such that the outer surface becomes the inner surface and the inner surface becomes the outer surface.

Background Art

Tubular knitted articles, such as socks or stockings, are usually manufactured on a circular knitting machine, provided with a single needle cylinder co-acting with a dial, or with two co-axial and superposed needle cylinders. The knitting process starts at one end of the tubular knitted article and terminates with the knitting of the last course of loops at the second end of tubular knitted article. In some circular knitting machines the tubular knitted article produced thereon has an open toe, which is usually the last end of the tubular knitted article to be formed by the needles of the knitting machine and which is open. The open toe of the tubular knitted article is subsequently closed by sewing or linking in a closing machine arranged near the needle cylinder.

To perform linking or sewing, the tubular knitted article shall be reversed, i.e. turned inside-out. Several devices for reversing the tubular knitted article have been developed. Devices for reversing tubular knitted articles are disclosed for instance in EP2250307, U.S. Pat. No. 9,562,307, U.S. Ser. No. 10/145,043, EP2961876, EP2946034, WO2002070801, WO2017080890, WO2008028575.

Handling tubular knitted articles, in particular fine-gauge women stockings, may damage the articles and lead to rejects. Damages can particularly occur in the phase of reversing socks or stockings. Devices and methods which handle the tubular knitted articles with care would be welcomed in the art and particularly useful.

Also, reversing tubular knitted articles of considerable length is time consuming and may involve additional handling of the article, which may add to the risk of damaging the articles and generate rejects. Providing a device and method capable of easily reverse long tubular knitted articles would be beneficial.

The subject matter disclosed herein concerns improvements to the reversing devices and methods aimed at alleviating or solving one or more of the drawbacks and limitations of the devices and methods of the current art.

While the description refers to preferred embodiments, wherein the reverting device is combined with a knitting machine for manufacturing tubular knitted articles (such as socks and stockings) including a toe closing station or machine, the method and device disclosed herein may also be used in different context, whenever a tubular article, particularly a flexible and supple article having first and second ends, at least one of which is open, must be turned inside-out, i.e. must be reversed.

SUMMARY

According to one aspect, a method is disclosed, wherein the tubular knitted article is engaged by a pick-up device such as to hang with an end thereof from the pick-up device. The tubular knitted article is introduced, with the end thereof hanging down from the pick-up device, in a reversing tube. The reversing tube is moved axially through the pick-up device so as to project with the upper end thereof above the pick-up device. The reversing tube is moved reciprocatingly up and down between an upper position and a lower position, in both positions the upper end of the reversing tube being located above the pick-up device. During the reciprocating movement the reversing tube co-acts with a top clamping device and a bottom clamping device, which selectively pinch the tubular knitted article against the reversing tube and release the tubular knitted article, such that the tubular knitted article is drawn from the interior of the reversing tube onto the outer surface thereof. The reciprocating motion is repeated for a sufficient number of times, until the tubular knitted article is entirely everted on the outer surface of the reversing tube.

According to preferred embodiments, disclosed herein is a method for reversing a tubular knitted article, comprising the following steps performed in sequence. A first end of the tubular knitted article is engaged by means of a plurality of annularly arranged pick-up members of a pick-up device, such that the tubular knitted article hangs with a second end thereof from the pick-up device. A reversing tube and the pick-up device are then arranged in an approximately coaxial position, with the reversing tube arranged under the pick-up device. The second end of the tubular knitted article and the portion of the tubular knitted article, which hangs down from the pick-up device, are introduced in the reversing tube through the upper end of the reversing tube.

Thereafter, the upper end of the reversing tube is moved upwards through the pick-up device and towards a first vertical position above the pick-up device. The movement of the upper end of the reversing tube through the pick-up device, which engages the first end of the tubular knitted article, causes eversion of the tubular knitted article onto an outer surface of the side wall thereof. In this step, only a partial eversion may be obtained, while a portion of the tubular knitted article may remain inside the reversing tube. This is particularly the case if the tubular knitted article is long compared to the extension of the reversing tube and to the extension of its upwards stroke.

If the tubular knitted article has not been completely everted, i.e. reversed inside out, at the end of the upwards stroke, the tubular knitted article is pinched between the upper end of the reversing tube and a top clamping device. Thereafter the upper end of the reversing tube and the top clamping device are moved from the first vertical position downward towards a second vertical position, lower than the first vertical position, i.e. arranged between the first vertical position and the annularly arranged pick up members of the pick-up device. This movement is preferably performed while the tubular knitted article is maintained pinched between the upper clamping device and the upper end of the reversing tube.

The next step provides for pinching the tubular knitted article against the outer surface of the side wall of the reversing tube by means of a bottom clamping device and the top clamping device is moved away from the reversing tube and moved back towards the first vertical position. The bottom clamping device is arranged near the pick-up device, i.e. between the pick-up device and the position of the upper end of the reversing tube, when the reversing tube is in the second vertical position. The position of the bottom clamping device is such that a sufficient distance is provided between the pick-up device and the bottom clamping device.

This is particularly beneficial, since in this manner during the downwards movement of the reversing tube from the first vertical position to the second vertical position the tubular knitted article, which was drawn from the interior of the reversing tube in the previous lifting stroke of the reversing tube, is collected around the outer surface of the reversing tube under the bottom clamping device. Once the bottom clamping device pinches the tubular knitted article against the reversing tube and this latter is lifted again towards the first vertical position, the length of tubular knitted article, which was everted and collected between the pick-up member and the bottom clamping device will not be drawn upwards by the reversing tube during its upwards movement.

In the following step, once the top clamping device is clear of the reversing tube, this latter is moved upwards again, towards the first vertical position, and the upwards movement causes further eversion of the tubular knitted article onto the outer surface of the side wall of the reversing tube.

At least a portion of the tubular knitted article, which is still inside the reversing tube when this latter is in the second vertical position, is withdrawn from the interior of the reversing tube and everted on the outer surface thereof, since the already reversed portion of the tubular knitted article is prevented from being drawn upwards by the upwardly moving reversing tube thanks to the pinching action of the bottom clamping device. This latter has a higher coefficient of friction than the outer surface of the reversing tube, such that when the reversing tube moves upwards, the tubular knitted article is retained by the high-friction bottom clamping device. The already reversed portion of the tubular knitted article, which has been collected between the bottom clamping device and the pick-up device during the previous downwards stroke of the reversing tube, is retained by the bottom clamping device and prevented from being drawn upwards by the reversing tube.

If required, the above described downwards and upwards movements of the reversing tube are repeated once or more times, as required, until the tubular knitted article is completely reversed inside-out on the outer surface of the side wall of the reversing tube, and the upper end of the reversing tube is clear of the tubular knitted article.

According to some embodiments, the step of moving the upper end of the reversing tube through the pick-up device and towards a first vertical position for the first time may further comprise the steps of: moving the upper end of the reversing tube in a position above the annularly arranged pick-up members; pinching the tubular knitted article against the outer surface of the side wall of the reversing tube with the bottom clamping device; and further moving the reversing tube towards the first vertical position.

According to a further aspect, a device for reversing a tubular knitted article is disclosed. The device comprises a pick-up device, which can include a plurality of annularly arranged pick-up members adapted to engage a first end of the tubular knitted article. The device further comprises a reversing tube having an upper end, a lower end and a side wall extending from the upper end to the lower end. The reversing tube and the pick-up device are adapted to be arranged in an approximately co-axial position. Moreover, the reversing tube is adapted to be lifted from a lower position under the pick-up device, such that the upper end of the reversing tube moves through the pick-up device towards a first, upper vertical position thereof above the pick-up device.

As used herein, an "approximately co-axial position" is such a position which allows the reversing tube to pass through the pick-up device. The two members do not require to be perfectly co-axial. What matters is that the reversing tube can move with the upper end thereof through the pick-up device to initiate the everting process.

The device further includes a top clamping device adapted to pinch the tubular knitted article against the upper end of the reversing tube in the upper vertical position above the pick-up device and to move together with the reversing tube between the upper vertical position towards a second, lower vertical position, said lower vertical position being above the pick-up device. The device also includes a bottom clamping device arranged between the first upper position and the pick-up device and adapted to move selectively between a pinching position, in which the bottom clamping device pinches the tubular knitted article against the side wall of the reversing tube, and a position clear of the reversing tube.

Further features and embodiments of the method and of the device are described here on, reference being made to the attached drawings.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein:

FIGS. 2 to 13 show details of the machine of FIG. 1 illustrating a sequence of steps of the method of removing the tubular knitted article from the needle cylinder, reversing the article, closing the toe of the article and discharging the article from the closing station.

DETAILED DESCRIPTION

In the following description the reversing method and device are described in combination with a circular knitting machine and a linking or sewing machine for closing an end, e.g. a toe end, of a tubular knitted article, for instance a sock or stocking. Those skilled in the art of knitting will nevertheless understand from the following description that novel and useful aspects of the invention can be used also in a different arrangement, for instance in cases where the reversed tubular knitted article is not subject to a sewing or linking action and/or wherein the tubular knitted article is not directly picked up from a circular knitting machine.

Figure 1:
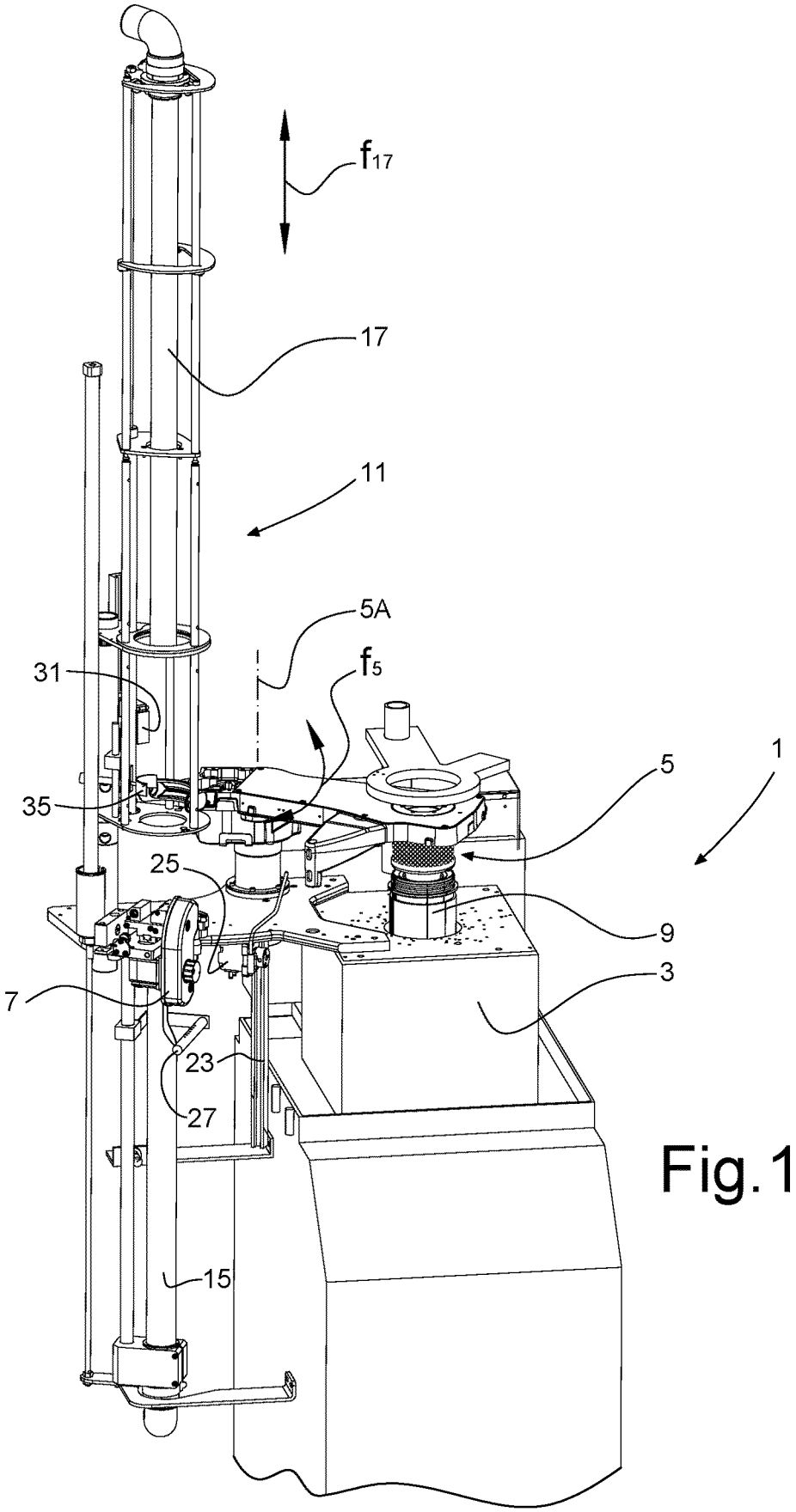
FIG. 1 illustrates an axonometric view of a knitting machine including a needle cylinder, a pick-up unit and a toe closing station.

Turning now to the drawings, FIG. 1 illustrates an axonometric view of a unit 1 including a circular knitting machine 3, a pick-up device 5 and a sewing or linking machine or station 7. Since the toe end of a tubular knitted article can be closed by sewing or linking, or any other suitable closing operation, the machine 7 will be referred to hereon simply as closing machine, or closing station, and the relevant operation performed by the closing machine 7 will be also simply referred to as "closing" or "closure" of the toe end of the tubular knitted article.

The circular knitting machine 3 includes a circular needle bed, for instance a needle cylinder 9. In some embodiments, the pick-up device 5 can be pivotable around a vertical axis 5A, to move from a pick-up position, in which the pick-up device is co-axial to the needle cylinder 9, to a reversing and closing position, in which the pick-up device 5 co-acts with the closing machine 7 and with a reversing arrangement cumulatively labeled 11.

Figure 1A:
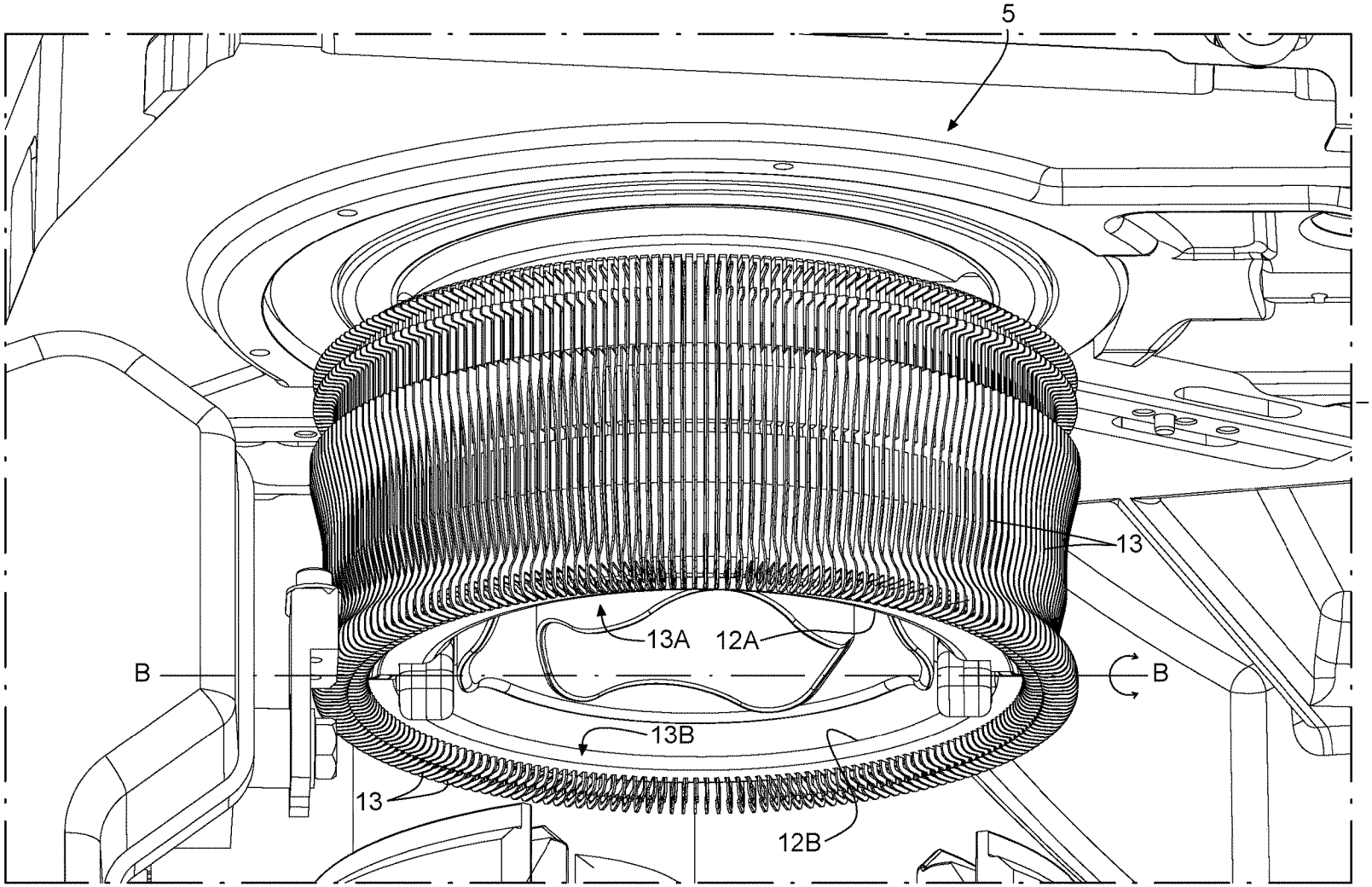
FIG. 1A illustrates an axonometric view of the pick-up member.

The pick-up device 5 will not be described in detail, since devices of this kind are known. For more details on possible embodiments of a pick-up device suitable for the unit 1 disclosed herein, reference can be made to U.S. Ser. No. 10/145043, WO2017067801, or EP2984220, for instance. FIG. 1A illustrates by way of example in an axonometric view from the bottom an embodiment of a pick-up device 5, including a plurality of pick-up members 13, which are arranged according to a first semi-circular set 13A of pick-up members 13 and a second semi-circular set 13B of pick-up members 13. More specifically, the pick-up device 5 comprises two semi-circular crowns 12A, 12B on which seats for the pick-up members 13A, 13B are provided, One of the two semi-circular sets of pick-up members is adapted to pivot with respect to the other about a diameter axis B-B, such that the first and second semi-circular sets of pick-up members can be arranged in a first co-planar position (FIG. 1A) and in a second superposed position, wherein the pick-up members of the two semi-circular sets are in a face-to-face relationship.

Figure 1B:
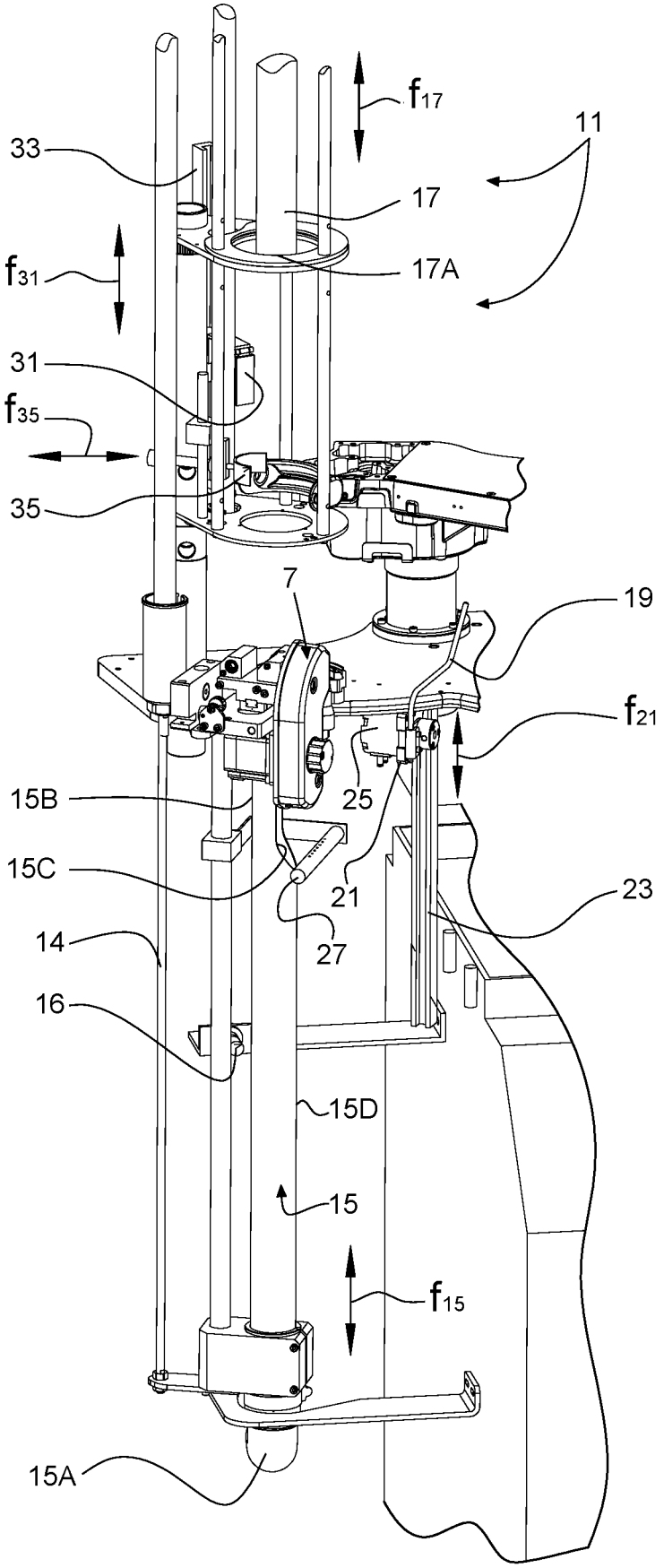
FIG. 1B illustrates an enlargement of the reversing arrangement of FIG. 1.

FIG. 1B illustrates an enlargement of the reversing arrangement 11, showing the various components thereof. Referring to FIG. 1B and with continuing reference to FIG. 1, the reversing arrangement 11 includes a reversing tube 15 which is provided with a vertical reciprocating motion according to double arrow f15. The movement can be controlled by an actuator 14. In this embodiment the actuator 14 is a linear actuator, i.e. a pneumatic cylinder-piston actuator. However, other actuators can be used, for instance a rotary actuator comprising an electric motor, or the like. A movable stop or lock 16 can be provided, to limit the downward movement of the reversing tube 15 in some of the steps of a reversing cycle, as will be described in more detail later on.

The reversing arrangement 11 further comprises an upper suction tube 17, which is substantially co-axial to the reversing tube 15 and arranged above thereof. The suction tube 17 is provided with a reciprocating vertical motion according to double arrow f17. The vertical movement of the suction tube 17 can be controlled by an actuator, for instance a linear actuator, such as a pneumatic cylinder-piston actuator, not illustrated in detail. Other actuators are possible for controlling the movements of the suction tube 17 and the reversing tube 15, for instance hydraulic cylinder-piston actuators, electric, pneumatic or hydraulic rotary motors, and the like.

In an idle position, as shown in FIGS. 1 and 1B, the suction tube 17 and the reversing tube 15 are arranged respectively above and below horizontal geometric planes which define the space in which the pick-up device 5 is swivelingly movable (double arrow f5, FIG. 1) by rotation around axis 5A. This enables introducing the pick-up device 5 between the reversing tube 15 and the suction tube 17.

The reversing arrangement 11 further includes means to introduce a tubular knitted article, which is engaged by the pick-up device 5, into the reversing tube 15. These means can include mechanical and/or pneumatic members. In the embodiment disclosed herein a combination of mechanical and pneumatic members is provided. More specifically, the means for introducing the tubular knitted article in the reversing tube 15 comprise a small bar 19, pivotally supported on a carriage 21. The vertical reciprocating movement of the carriage 21 according to double arrow f21 can be controlled by any suitable actuator. In the exemplary embodiment illustrated in the drawings, a rod-less or shaft-less pneumatic cylinder-piston actuator 23 is used, which also forms a guide for guiding the carriage 21. Other actuators can be used for controlling the motion of the carriage 21. It shall be noted that in general the actuators used for controlling the displacement of the various members of the machine can be chosen among any kind of suitable actuator available, irrespective of the type and nature of the specific actuator described herein, unless differently specified. The small bar 19 is further pivotally movable about a horizontal axis under the control of a rotary actuator 25 supported by the carriage 21. The means for introducing the sock in the reversing tube 15 can further include pneumatic means, for instance a blowing nozzle or a set of blowing nozzles provided on a blowing member, such as a blowing bar 27, which generate air jet(s) or blasts, directed such as to facilitate insertion of the tubular knitted article in the reversing tube 15. Suction in the reversing tube may be used instead of, or in combination with the air blast generated by the nozzles.

In some embodiments, not shown, the blowing bar 27 can be provided with a reciprocating vertical movement, to facilitate the insertion of the tubular knitted article S in the reversing tube 15. In some embodiments, the blowing bar 27 can be replaced by a substantially horizontal bar, without blowing nozzles and provided with a reciprocating vertical movement.

The reversing tube 15 has a lower end 15A and an upper end 15B (best shown in FIG. 9) as well as a side wall 15D extending between the lower end 15A and the upper end 15B. In some embodiments the side wall 15D has a side opening 15C, which facilitates the insertion of the tubular knitted article therein, as will be explained in more detail later on. In some embodiments, not shown, the reversing tube 15 may be provided also with a pivoting movement around a horizontal axis to take a position which makes the insertion of the tubular knitted article easier.

Above the plane along which the pick-up device 5 is swivelingly movable, two clamping devices can be arranged, which co-act with the reversing tube 15 in order to reverse the tubular knitted article inside out. More specifically, a top clamping device 31 is adapted to move according to arrow f31 along a vertical guide 33. A further, bottom clamping device 35 is arranged at a lower level, below the top clamping device 31 and above the pick-up device 5. The bottom clamping device 35 is movable in a horizontal direction according to double arrow f35. The motions according to f31 and f35 of the top clamping device 31 and of the bottom clamping device 35 can be controlled by suitable actuators, for instance shaft-less or rod-less pneumatic cylinder-piston actuators, or other types of suitable actuators.

With continuing reference to FIGS. 1, 1A, 1B, a reversing cycle will be described in greater detail with reference to FIGS. 2-13. The reversing cycle comprises a first sequence of steps (FIGS. 2-5) to remove the tubular knitted article S from the needle cylinder 9 and introduce said article in the reversing tube 15. A second sequence of steps reverse the tubular knitted article S inside out.

Figure 2:
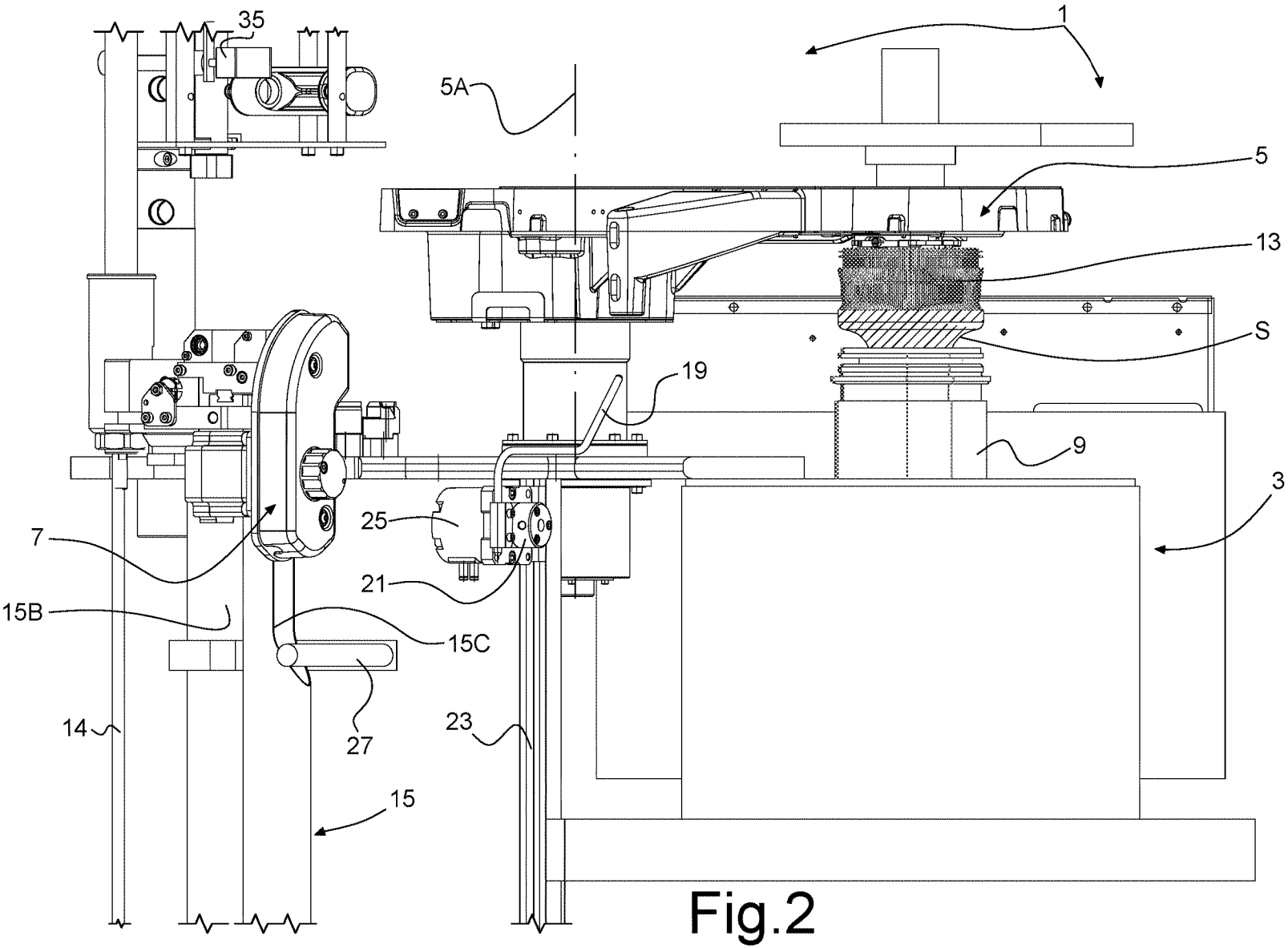

In FIG. 2 a first step of the first sequence is illustrated. The knitting machine 3 has ended the production of a tubular knitted article S, such as a sock or stocking. The knitting process starts with an elastic welt and ends with the toe of the article. In the following description the toe will be referred to as the "first end", which is to be closed be sewing or linking. The elastic welt will be referred to as "second end" of the tubular knitted article. In FIG. 2 the toe of the tubular knitted article S is already engaged by the pick-up members 13 (shown in detail in FIG. 1A) of the pick-up device 5. This latter is still in the pick-up position, co-axial to the needle cylinder 9. The reversing tube 15 is in the lower position. The suction tube 17, not visible in FIG. 2, is in the upper position.

Figure 3:
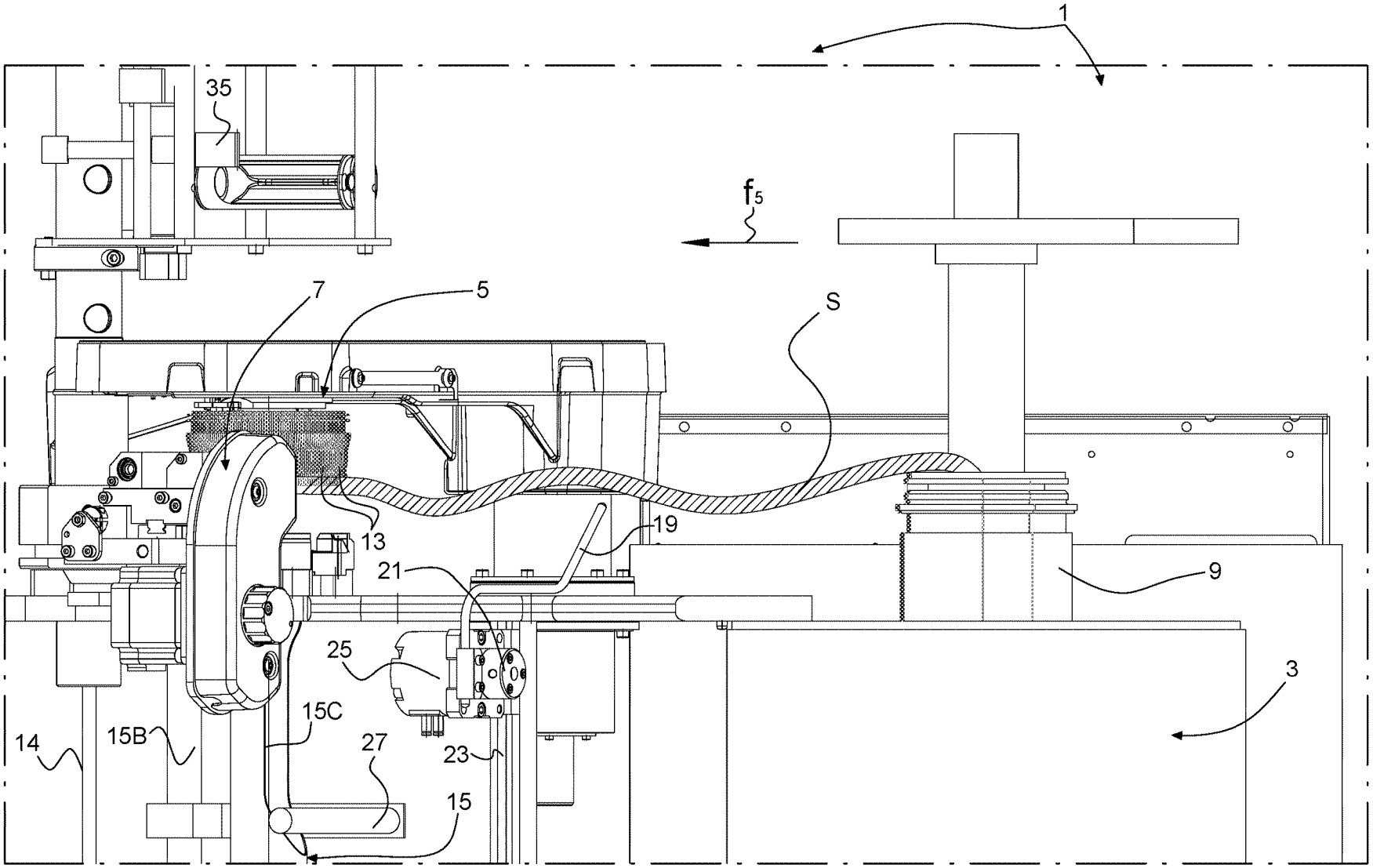

From the position of FIG. 2 to the position of FIG. 3 the pick-up device 5 rotates around the vertical axis 5A. In FIG. 3 the pick-up device 5 is positioned between the reversing tube 15 and the suction tube 17 and substantially co-axial therewith. In this exemplary embodiment the tubular knitted article S is particularly long, such that when the pick-up device 5 is in the position of FIG. 3, the second end of the tubular knitted article S is still inside the needle cylinder 9.

Figure 4:
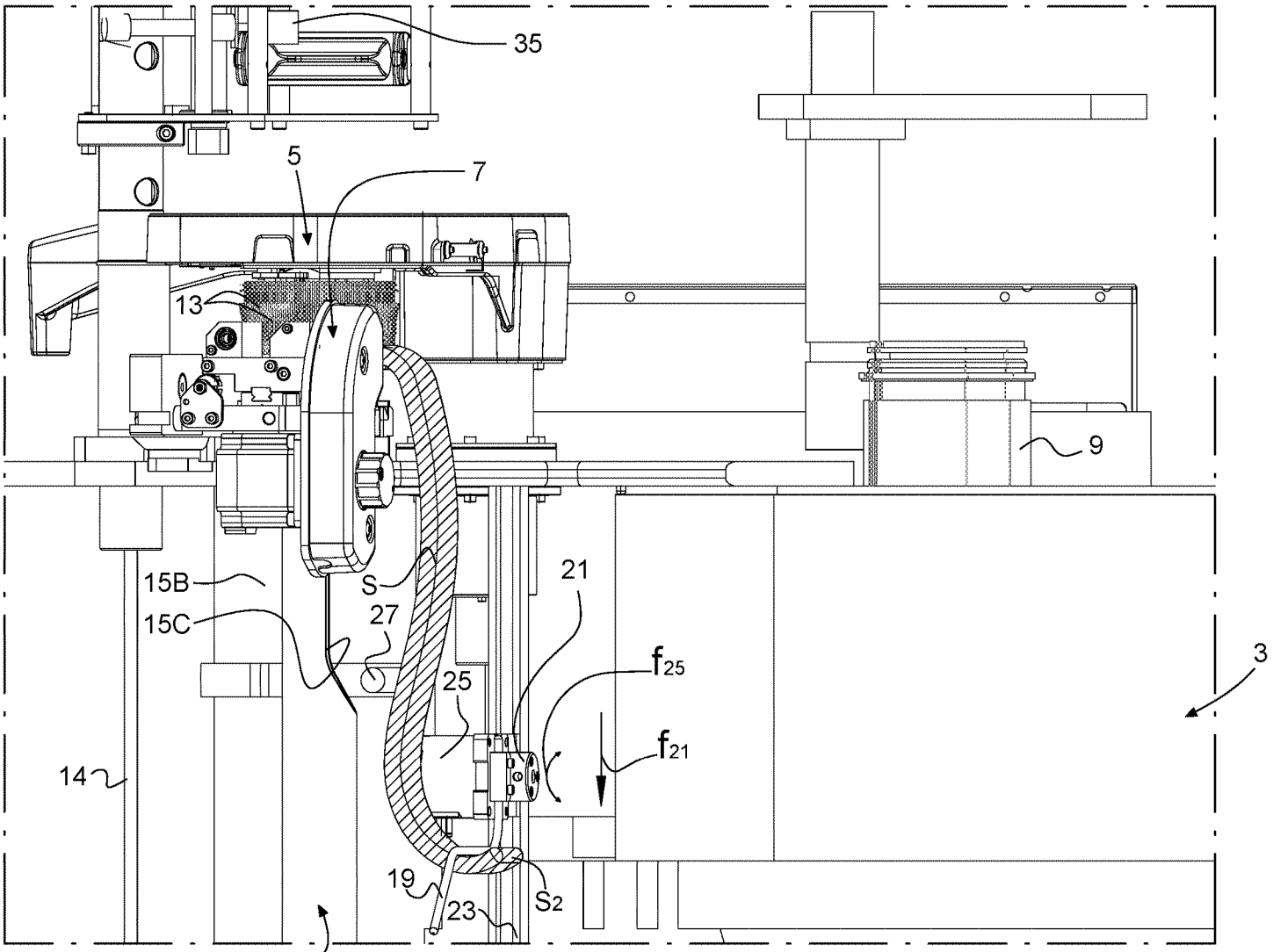
Figure 5:
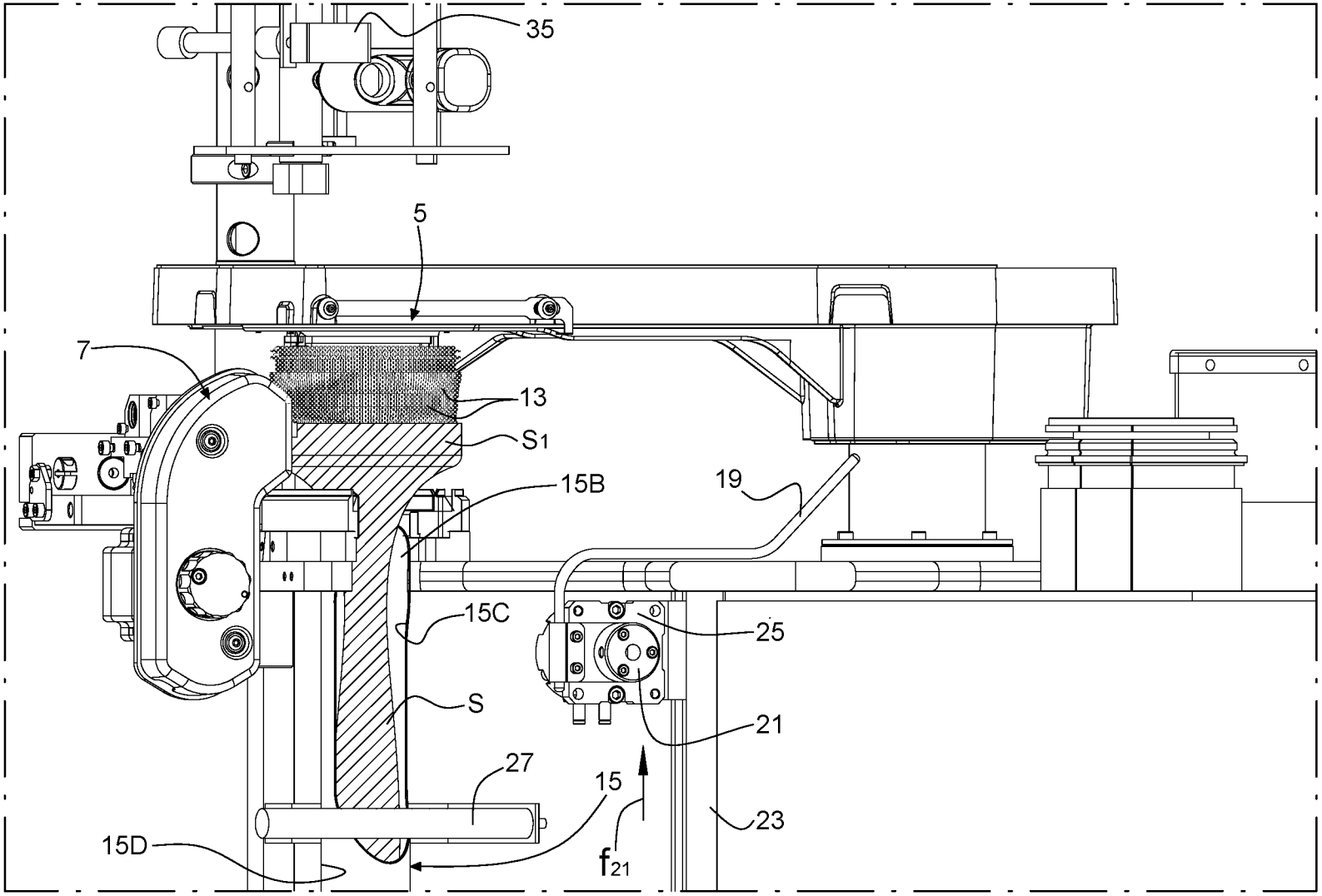

In order to entirely remove the tubular knitted article S from the needle cylinder 9 and introduce the lower part thereof in the reversing tube 15 the small bar 19 rotates and translates downward according to arrow f21 in FIG. 4. A combined air suction through the reversing tube 15 and air blowing through the blowing bar 27 introduce the part of the tubular knitted article S hanging down from the pick-up device 5 into the reversing tube 15, as shown in FIG. 5. Now the open toe end S1 of the tubular knitted article S is engaged by the pick-up members 13 of the pick-up device 5, while the second, lower end S2 thereof freely hangs downwards inside the reversing tube 15.

The following second sequence of steps are now performed to reverse the tubular knitted article S inside-out.

In FIG .6 the reversing tube 15 is moved upwards according to arrow f15 such that the upper end 15B of the reversing tube 15 moves through the pick-up device 5 up to a first, upper vertical position. The upward stroke of the reversing tube 15 can be performed while the bottom damping device 35 is maintained inactive, i.e., distanced from the reversing tube 15. In an alternative embodiment, the upwards stroke can be divided into a first partial stroke and a second partial stroke. At the end of the first partial stroke, the upper end 15B of the reversing tube 15 is located above the pick-up device 5 and is at or above the position where the bottom damping device 35 is positioned. The bottom clamping device 35 is activated and pushed against the outer surface of the side wall 15D of the reversing tube 15, such that the tubular knitted article S is pinched between the bottom clamping device 35 and the reversing tube 15. When performing the second stroke of the upwards movement the smooth outer surface (which can be polished) of the reversing tube 15 slides on the inner surface of the tubular knitted article S, which remains adherent to the bottom clamping device 35 by friction.

Irrespective of whether the bottom clamping device 35 is active or idle, the upwards movement of the reversing tube 15 causes the tubular knitted article S, which is inside the reversing tube 15, to be pulled outside thereof and evert on the outer surface of the side wall 15D of the reversing tube 15. If the bottom clamping device 35 is inactive, pulling of the tubular knitted article S outside the reversing tube 15 is ensured by the retention action exerted by the pick-up members 13, which prevent the tubular knitted article S to be drawn upwards by friction. In this step, therefore, the tubular knitted article S slides along the upper edge of the reversing tube 15 and is gradually pulled outside the reversing tube 15 and everted therearound.

Figure 6:
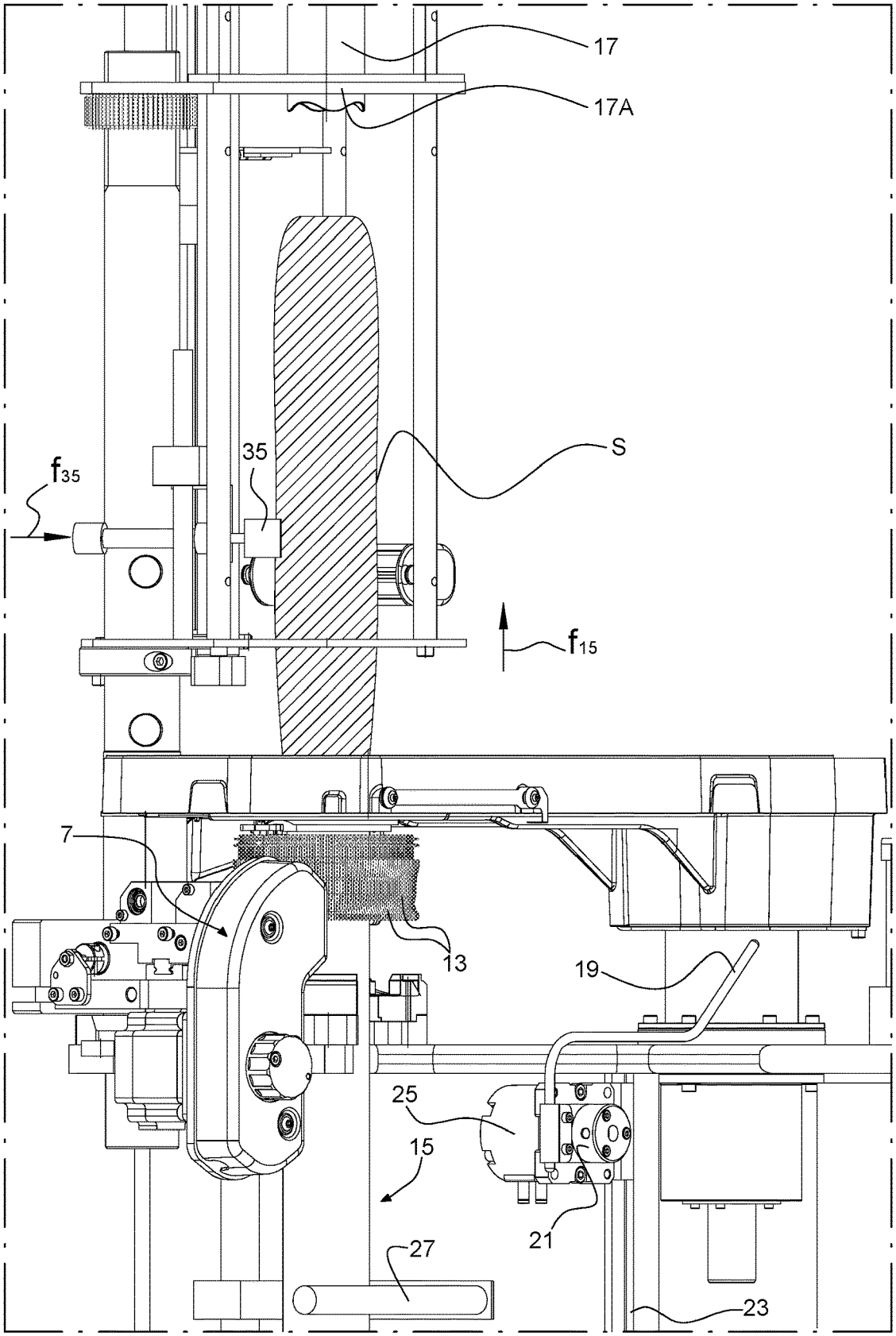

If, once the reversing tube 15 has achieved its upper position, i.e. the first vertical position shown in FIG. 6, the entire tubular knitting article has been pulled out from the interior of the reversing tube 15 and is arranged around the outer surface of the reversing tube 15, the reversing process is ended. This can be detected for instance by means of a photocell or a light emitting-receiving arrangement, which uses a reflecting outer surface of the reversing tube 15. If the tubular knitted article S has been fully reversed, the upper end 15B of the reversing tube 15 is free of fabric, a condition which can be optically detected. Other detection means can be used, such as capacitive means or simply an electric contact co-acting with the outer surface of the reversing tube 15.

In other embodiments, the length of the tubular knitted article S can be stored in a storage memory of a control unit. The control unit may be programmed such as to determine whether the tubular knitted article S has been fully reversed inside-out at the end of the first upwards stroke of the reversing tube 15, based on the stored length of the tubular knitted article S.

If a portion of the tubular knitted article S is still inside the reversing tube 15, a further reversing step, shown in FIGS. 7A, 7B is performed. The two figures illustrate two enlarged portions of the device. More specifically, FIG. 7A illustrates an area around the upper end 15B of the reversing tube 15, while FIG. 7B illustrates the area under the pick-up member. As shown in FIG. 7A, the top clamping device 31 has been activated such that the tubular knitted article S is pinched between the top clamping device 31 and the upper end 15B of the reversing tube 15. Once the tubular knitted article S is pressed by the top clamping device 31 against the reversing tube 15 and safely retained therebetween, the reversing tube 15 and the top clamping device 31 can simultaneously move downwards according to arrows f31 and f15 in FIG. 7A. The bottom clamping device 35 is clear of the reversing tube 15 and the tubular knitted article S arranged therearound, such that the tubular knitted article S can be drawn by the downwardly moving reversing tube 15 without interfering with the bottom clamping device 35. The gap between the annular arrangement of pick-up members 13 and the outer surface of the reversing tube 15 is sufficiently small to prevent the tubular knitted article S from being drawn downwards by the reversing tube 15.

The lowering motion of the reversing tube 15 ends before the upper end 15B thereof moves past the bottom clamping device 35. This latter is placed at a distance above the pick-up device 5, such that at least a portion of the tubular knitted article S, which is on the outer surface of the reversing tube 15 will collect around the downwardly moving reversing tube 15, between the bottom clamping device 35 and the pick-up device 5.

The end of the lowering stroke of the reversing tube 15 can be defined by the movable stop 16. FIG. 7B illustrates the lower portion of the reversing tube 15 at the end of this partial lowering stroke. Using a movable stop 16 avoids the need of accurately controlling the actuator that moves the reversing tube 15. Thus, a simple cylinder-piston actuator can be used to control the up-and-down movement of the reversing tube 15.

In other embodiments, the movement of the reversing tube 15 can be controlled by a more sophisticated actuator, such as an electronically controlled electric motor. In yet further embodiments, magnetic control devices combined to piston-cylinder actuators can be used to perform strokes of the required length. The end of the lowering stroke can be controlled electronically.

As shown in FIG. 7A, at the end of the downwards movement of the reversing tube 15 a portion of the tubular knitted article S has piled up forming folds SC around the outer surface of the reversing tube 15, between the pick-up device 5 and the bottom clamping device 35. As mentioned above, for an efficient operation of the device, the bottom clamping device 35 is located in an intermediate position between the first vertical position reached by the upper end 15B of the reversing tube 15 and the pick-up device 5. The distance between the bottom clamping device 35 and the pick-up device 5 is such that the tubular knitted article S can at least partly collect between the bottom clamping device 35 and the pick-up device 5 during the downwards movement of the reversing tube 15.

Figure 8:
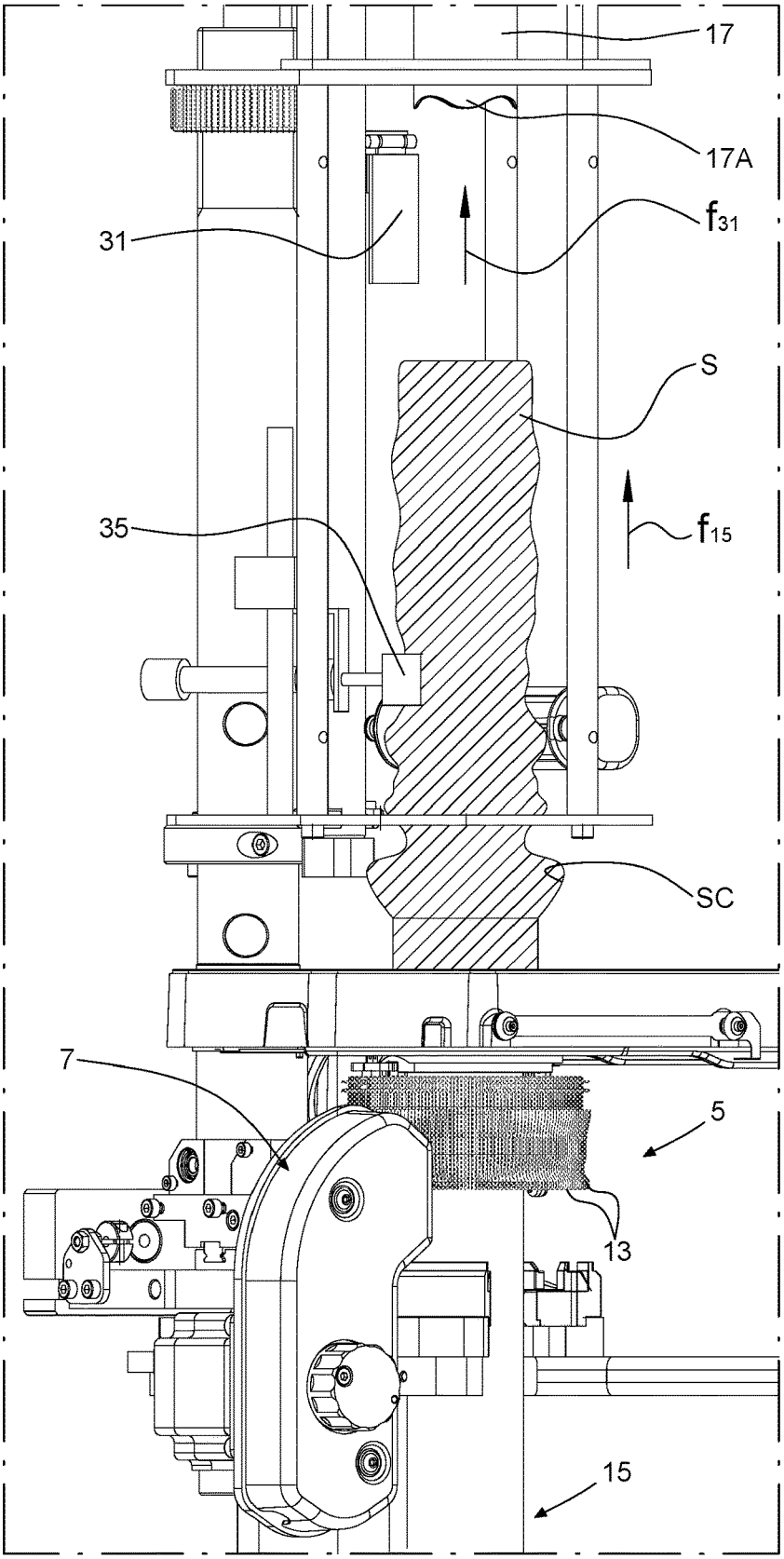

In the next step (FIG. 8), the top clamping device 31 is moved clear of the upper end 15B of the reversing tube 15, in order to allow the next everting step to be performed. By moving the top clamping device 31 away from the upper end 15B of the reversing tube 15 the tubular knitted article S becomes free to be further pulled out from the reversing tube 15. As shown in FIG. 8, the top clamping device 31 can be moved back (arrow f31) to its upper vertical position.

The bottom clamping device 35 is activated, such that the tubular knitted article S is clamped, i.e. pinched between the bottom clamping device 35 and the outer surface of the reversing tube 15. This latter can be moved upwards, as shown by arrow f15 in FIG. 8, towards the upper first vertical position again. During this movement a further portion of the tubular knitted article is pulled out from the interior of the reversing tube 15. In fact the portion of the already everted tubular knitted article S, which is collected (see folds SC, FIGS. 7A, 8, 9) under the bottom clamping device 35, is prevented from being drawn by the upwardly moving reversing tube 15, due to the action of the bottom clamping device, which has a coefficient of friction higher than the outer surface of the reversing tube 15.

Figure 9:
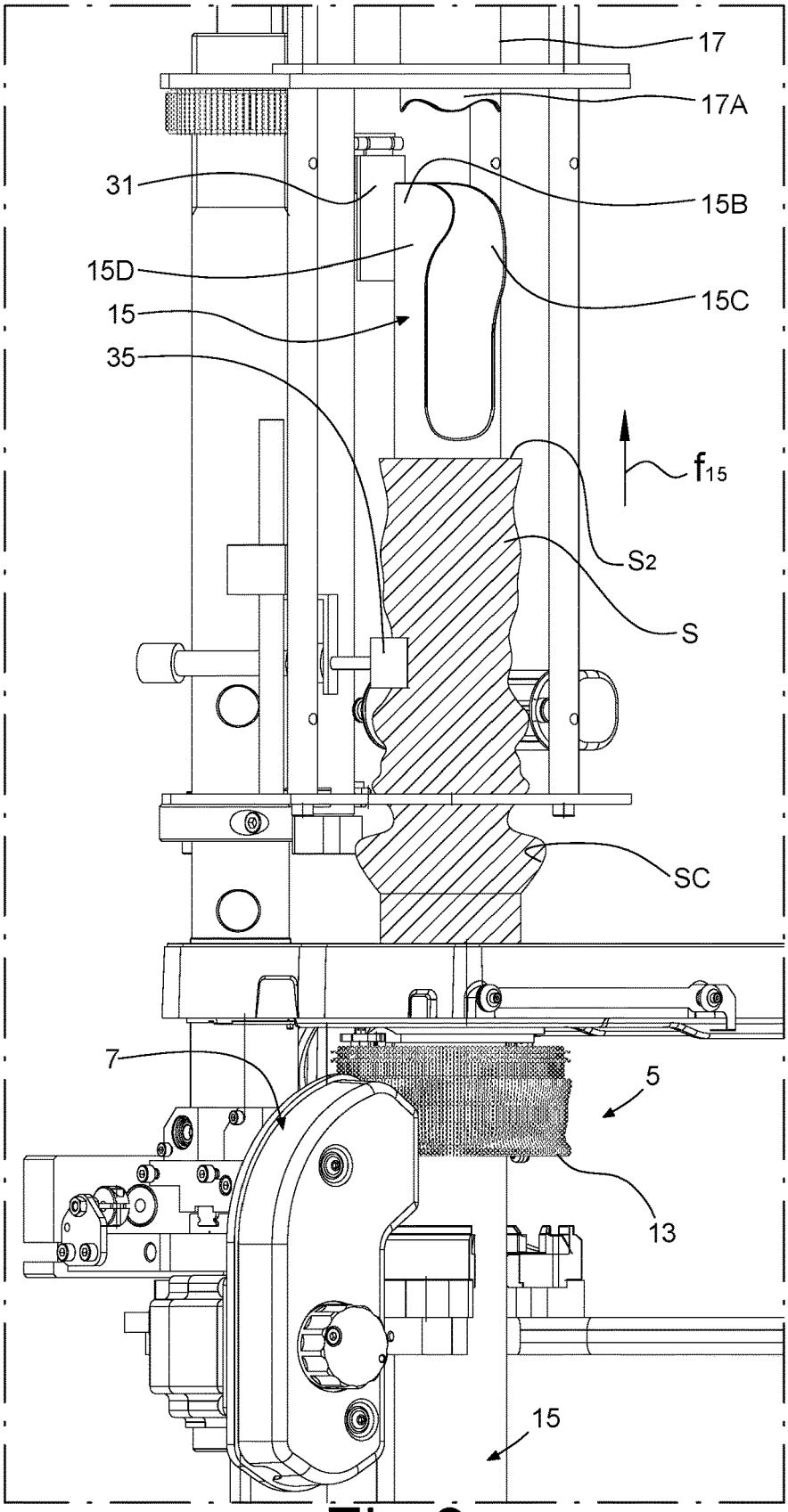

At the end of this further upward stroke of the reversing tube 15 the tubular knitted article S can be entirely outside the reversing tube 15, as shown in FIG. 9. The upper end 15B of the reversing tube 15 is in this case free of the tubular knitted article S, a condition which can be detected optically or in any other suitable manner. For instance, in some embodiments, the number of strokes can be programmed at the out-set, based on the length of the tubular knitted article S to be handled. This may simplify the structure and control of the machine. The reversing or everting process is thus concluded If the tubular knitted article S is particularly long, it may not be fully pulled out the reversing tube 15 at the end of the second upwards stroke of the reversing tube 15. In such case, the same steps described above in connection to FIGS. 7A, 7B, 8 are repeated once or more times, until the entire tubular knitted article S is outside the reversing tube 15 and preferably below the side opening 15C.

In preferred embodiments, the reversing process goes on, with repeated reciprocating movements of the reversing tube 15, until the tubular knitted article S is clear of the side opening 15C of the reversing tube 15, as shown in FIG. 8

Figure 10:
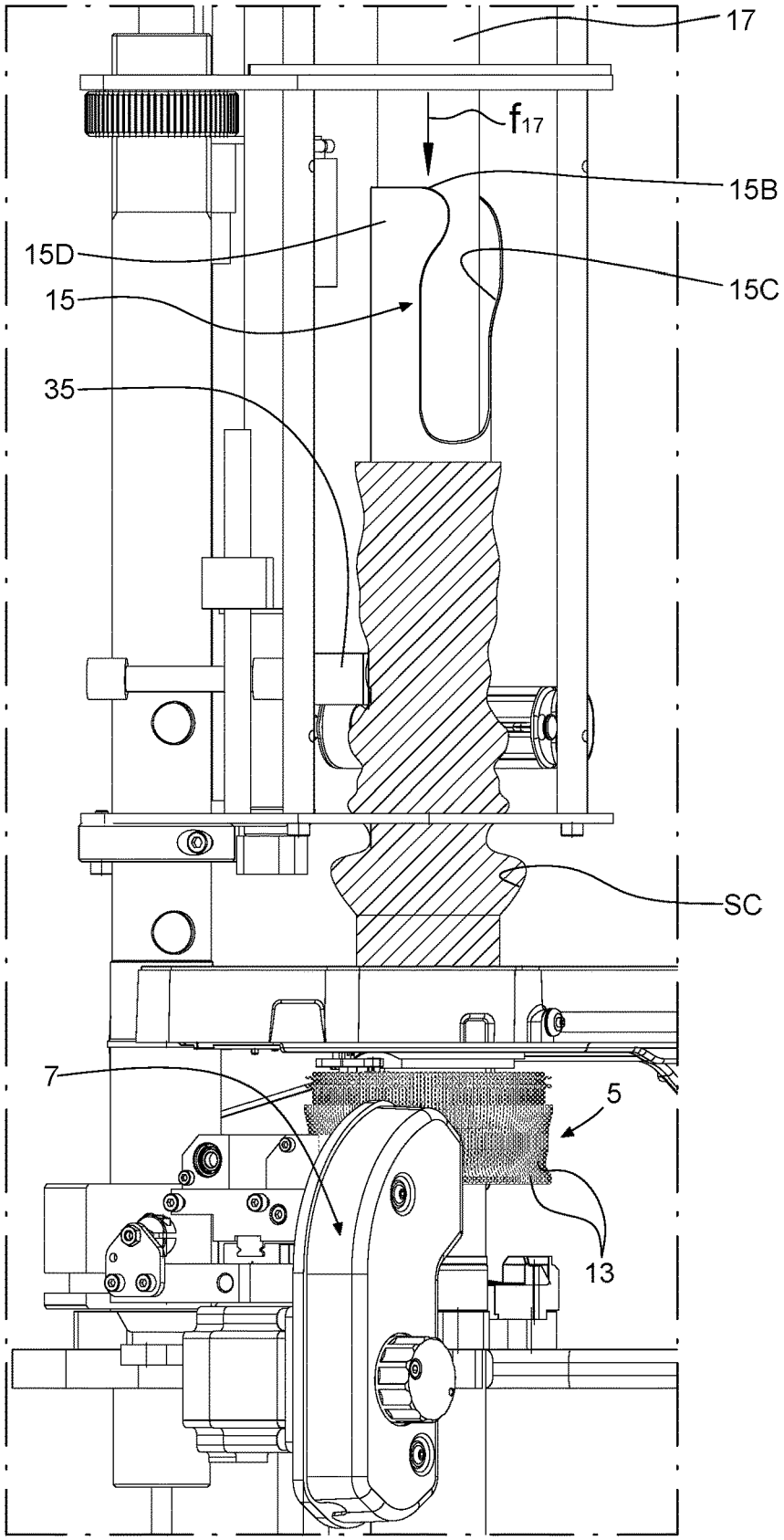

The next step is shown in FIG. 10. The upper suction tube 17 is lowered (arrow f17 in FIG. 10), such that the lower end 17A thereof is introduced coaxially into the upper end 15B of the reversing tube 15.

Figure 11:
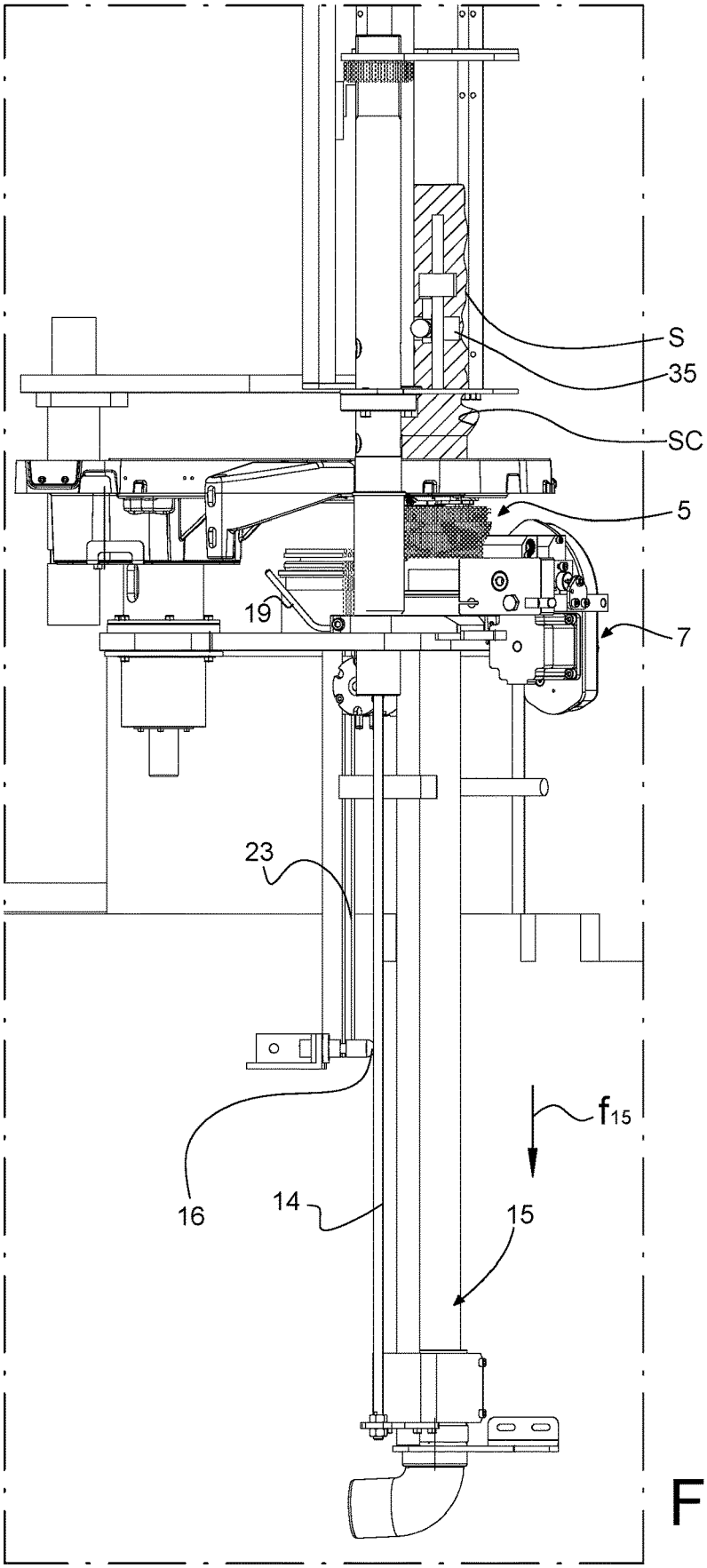

The reversing tube 15 can now be moved back in its bottom-most position. This may require retraction of the stop 16, if provided. FIG. 11 illustrates this new condition. The lower end 17A of the suction tube 17 is positioned at or above the pick-up device 5, the reversing tube 15 is back in its lower position such that the area of the pick-up device 5 is free and closing of the toe end, which is engaged by the pick-up members 13, can be performed.

In the embodiment disclosed herein the closing of the toe end is performed by co-action of the pick-up device 5 with the closing machine 7. However, this is not mandatory. As known in the art, sewing or linking of the toe end can be performed using an additional device, different from the pick-up device 5, and on which the tubular knitted article S is transferred once it has been removed from the knitting machine 3.

In the embodiment described herein, the toe end of the tubular knitted article S is closed, by sewing or linking, while still engaged by the pick-up members 13, once the two semi-circular sets 13A, 13B of pick-up members have been brought in an over-lapping and face-to-face position. Once the toe end has been closed, the two semi-circular sets 13A, 13B of pick-up members are brought in a co-planar arrangement again, while the tubular knitted article is removed from the pick-up members 13.

Figure 12:
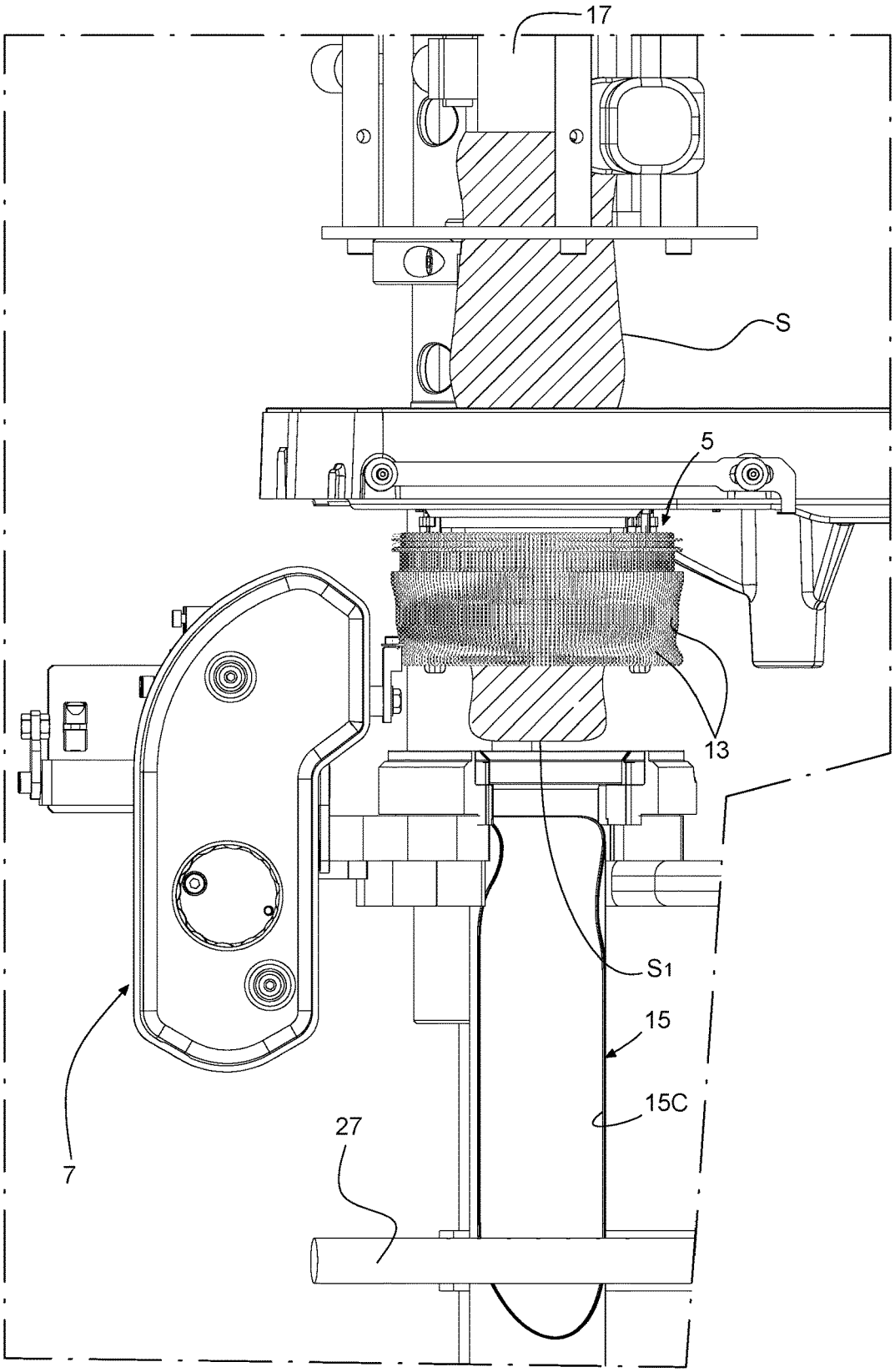
Figure 13:
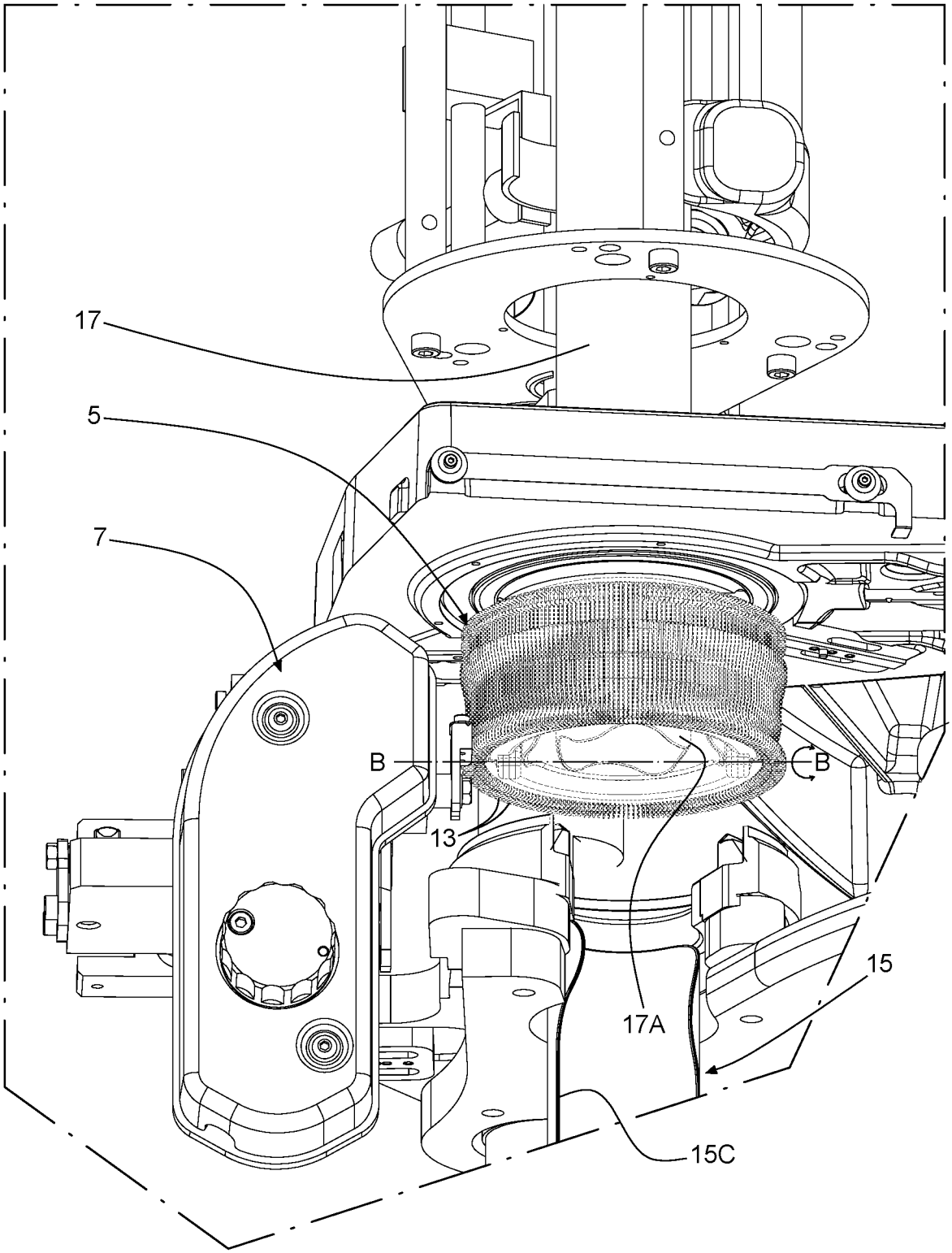

FIG. 12 shows the step in which the toe end S1 has been closed. The toe portion is located on the bottom end of the suction tube 17. The closed tubular knitted article S is then sucked into the suction tube 17, as shown in FIG. 13.

In the embodiment described above and illustrated in the attached drawings a single pick-up device is used to: a) picking up the tubular knitted article from the needle cylinder, b) transferring the tubular knitted article in a reversing and closing station, c) reversing the tubular knitted article, and d) closing the toe end. However, in other embodiments an additional transfer step of the tubular knitted article can be foreseen, such that for instance a first device removes the tubular knitted article from the needle bed and a second device receives the tubular knitted article from the first device to perform the remaining operations (reversing, closing and discharging). In yet further embodiments, a first device can be used to pick-up the tubular knitted article from the needle bed 9 and reverse the tubular knitted article. This latter is then transferred to a second device, on which the end of the tubular knitted article is closed and wherefrom the tubular knitted article with the closed end is removed by suction through the suction tube.

While the invention has been described in terms of various specific embodiments, it will be apparent to those of ordinary skill in the art that many modifications, changes, and omissions are possible without departing form the spirit and scope of the claims. In addition, unless specified otherwise herein, the order or sequence of any process or method steps may be varied or re-sequenced according to alternative embodiments.

What is claimed is:

1. A method for reversing a tubular knitted article, wherein:

the tubular knitted article, engaged at a first end thereof by a pick-up device and hanging with a second end thereof from the pick-up device, is introduced in a reversing tube, the reversing tube comprising a lower end, an upper end and a side wall extending from the lower end to the upper end;

the reversing tube is moved through the pick-up device so as to project with the upper end thereof above the pick-up device; and the reversing tube is moved reciprocatingly up and down between an upper position and a lower position, while co-acting with a top clamping device and a bottom clamping device until the tubular knitted article is entirely everted on the outer surface of the reversing tube, the method comprising the following steps:

(a) engaging the first end of the tubular knitted article by means of a plurality of annularly arranged pick-up members of the pick-up device, such that the tubular knitted article hangs with the second end thereof from the pick-up device;

(b) arranging the reversing tube and the pick-up device in an approximately coaxial position, with the reversing tube arranged under the pick-up device, and introducing the second end of the tubular knitted article in the reversing tube through the upper end thereof;

(c) moving the upper end of the reversing tube through the pick-up device and towards a first vertical position above pick-up device, the movement of the upper end of the reversing tube causing eversion of the tubular knitted article onto an outer surface of the side wall of the reversing tube;

(d) pinching the tubular knitted article between the upper end of the reversing tube and the top clamping device;

(e) moving the upper end of the reversing tube and the top clamping device from the first vertical position downward towards a second vertical position, arranged between the first vertical position and the annularly arranged pick up members while the bottom clamping device is maintained clear of the tubular knitted article;

(f) pinching the tubular knitted article against the outer surface of the side wall of the reversing tube with the bottom clamping device;

(g) moving the top clamping device back towards the first vertical position;

(h) when the top clamping device is clear of the reversing tube, moving the reversing tube towards the first vertical position, while the bottom clamping device retains a portion of already reversed tubular knitted article pinched against the outer surface of the reversing tube, thus preventing said portion of tubular knitted article from being drawn upwards by the reversing tube, whereby the upwards movement of the reversing tube causes further eversion of the tubular knitted article onto the outer surface of the side wall of the reversing tube; and (i) if required, repeating steps (d) to (h) until the tubular knitted article is completely reversed inside-out on the outer surface of the side wall of the reversing tube.

2. The method of claim 1, further comprising the step of inserting a lower end of a suction tube inside the upper end of the reversing tube when the tubular knitted article is completely reversed inside-out on the outer surface of the side wall of the reversing tube.

3. The method of claim 2, further comprising the step of withdrawing the reversing tube from the pick-up device.

4. The method of claim 1, further comprising the step of withdrawing the reversing tube from the pick-up device.

5. The method of claim 1 further comprising the step of closing the first end of the tubular knitted article.

6. The method of claim 5, wherein the step of closing the first end of the tubular knitted article is performed while the first end is engaged by the pick-up device.

7. The method of claim 6, wherein the step of closing the first end of the tubular knitted article comprises the steps of:

rotating a first semi-circular set of pick-up members and a second semi-circular set of pick-up members from a coplanar position in a superposed position, in which the first semi-circular set of pick-up members faces the second semi-circular set of pick-up members; and sewing or linking together opposing edge portions of the first end of the tubular knitted article retained by the superposed first and second semi-circular sets of pick-up members.

8. The method of claim 7, further comprising the step of rotating the first semi-circular set of pick-up members and the second semi-circular set of pick-up members back in the co-planar position and removing the tubular knitted article by suction through the suction tube.

9. The method of claim 1, further comprising the following steps:

knitting a tubular knitted article with a needle cylinder of a circular knitting machine;

placing the pick-up device coaxial to a needle cylinder;

transferring the tubular knitted article from the needle cylinder to the pick-up device, such that the first end of the tubular knitted article is engaged by the pick-up members; and removing the pick-up device from the needle cylinder before introducing the second end of the tubular knitted article into the reversing tube.

10. The method of claim 9, wherein the method of introducing the tubular knitted article into the reversing tube includes the steps of generating a suction inside the reversing tube and/or an air jet outside the reversing tube.

11. A device for reversing a tubular knitted article, comprising:

a pick-up device adapted to engage a first end of the tubular knitted article;

a reversing tube having an upper end, a lower end and a side wall extending from the upper end to the lower end, wherein the reversing tube and the pick-up device are adapted to be arranged in an approximately co-axial position, and wherein the reversing tube is adapted to move upwards through the pick-up device, from a position in which the upper end of the reversing tube is located under the pick-up device, to a position, in which the upper end of the reversing tube is located in a first vertical position above the pick-up device;

a top clamping device adapted to pinch the tubular knitted article against the upper end of the reversing tube in the upper vertical position above the pick-up device and to move together with the reversing tube between the upper vertical position towards a second, lower vertical position, said lower vertical position being above the pick-up device; and a bottom clamping device arranged between the first upper position and the pick-up device and adapted to move selectively between a pinching position, adapted to pinch the tubular knitted article against the side wall of the reversing tube, and a position clear of the reversing tube.

12. The device of claim 11, wherein the pick-up device comprises a plurality of annularly arranged pick-up members arranged according to a first semi-circular set of pick-up members and a second semi-circular set of pick-up members, hinged to one another about an axis parallel to the annular arrangement of pick-up members; and wherein the first semi-circular set of pick-up members and the second semi-circular set of pick-up members are adapted to be selectively placed in a co-planar position and in a superposed position, wherein the first semi-circular set of pick-up members are arranged in a face-to-face relationship with the second semi-circular set of pick-up members.

13. The device of claim 12, further comprising a blowing member adapted to facilitate the insertion of the tubular knitted article in the reversing tube; and wherein the reversing tube is preferably combined with a suction arrangement, adapted to generate suction in said reversing tube.

14. The device of claim 11, further comprising a blowing member adapted to facilitate the insertion of the tubular knitted article in the reversing tube; and wherein the reversing tube is preferably combined with a suction arrangement, adapted to generate suction in said reversing tube.

15. A unit comprising:

a circular knitting machine having a needle cylinder; and a device for reversing a tubular knitted article; wherein the device for reversing the tubular knitted article comprises:

a pick-up device adapted to engage a first end of the tubular knitted article;

a reversing tube having an upper end, a lower end and a side wall extending from the upper end to the lower end, wherein the reversing tube and the pick-up device are adapted to be arranged in an approximately co-axial position, and wherein the reversing tube is adapted to move upwards through the pick-up device, from a position in which the upper end of the reversing tube is located under the pick-up device, to a position, in which the upper end of the reversing tube is located in a first vertical position above the pick-up device;

a top clamping device adapted to pinch the tubular knitted article against the upper end of the reversing tube in the upper vertical position above the pick-up device and to move together with the reversing tube between the upper vertical position towards a second, lower vertical position, said lower vertical position being above the pick-up device; and a bottom clamping device arranged between the first upper position and the pick-up device and adapted to move selectively between a pinching position, adapted to pinch the tubular knitted article against the side wall of the reversing tube, and a position clear of the reversing tube.

16. The unit of claim 15, further comprising a closing machine, adapted to co-act with the pick-up device and close the first end of a tubular knitted article retained by the pick-up device.

* * * * *